US006515267B1

(12) United States Patent
Linden

(10) Patent No.: US 6,515,267 B1
(45) Date of Patent: Feb. 4, 2003

(54) METHOD OF AND APPARATUS FOR SOFT IONIZATION OF ANALYTE SUBSTANCES

(76) Inventor: H. Bernhard Linden, Auf Dem Berge 25, D-28844 Leeste/Weyhe (DE)

( * ) Notice: Subject to any disclaimer, the term of this patent is extended or adjusted under 35 U.S.C. 154(b) by 0 days.

(21) Appl. No.: 09/585,002

(22) Filed: Jun. 1, 2000

(30) Foreign Application Priority Data

Dec. 22, 1999 (DE) ..... 199 63 317

(51) Int. Cl.[7] ..... H01J 49/00; H01J 27/00

(52) U.S. Cl. ..... 250/123 R; 250/281; 250/282; 250/288

(58) Field of Search ..... 250/282, 288, 250/423 R, 432 R, 281

(56) References Cited

U.S. PATENT DOCUMENTS 4,175,234 A * 11/1979 Hunt et al. ..... 250/427
4,301,369 A * 11/1981 Matsuo et al. ..... 250/423 R
4,888,482 A * 12/1989 Kato ..... 250/281
6,166,379 A * 12/2000 Montaser et al. ..... 250/288

* cited by examiner

*Primary Examiner*—John R. Lee
*Assistant Examiner*—David A. Vanore
(74) *Attorney, Agent, or Firm*—Rodgers & Rodgers

(57) ABSTRACT

The invention refers to a method effecting a soft ionization desorption of analyte substances from an adsorbed liquid matrix with an ion current intensity up to more than two orders of magnitude higher than field ionization desorption under similar conditions but without liquid matrix and to an apparatus for ionization of analyte substances consisting of a sample feed pipe to which micro-dendrites are directly coordinated making possible a sample supply to the dendrites without loss and with a total duty cycle time of up to below 90 seconds per sample for application of the analyte to the dendrites, ionization desorption of the molecules of interest, and heating clean of the micro-dendrites ahead of the next application of another sample.

6 Claims, 1 Drawing Sheet

METHOD OF AND APPARATUS FOR SOFT IONIZATION OF ANALYTE SUBSTANCES

BACKGROUND OF THE INVENTION

The present invention relates to a device for ionization of analyte substances taking place in a high electrical field at the micro-tips of graphitic, silica, metallic or other dendrites.

In field-ionization and field-desorption mass spectrometry, electrodes are known having a 0.01 mm diameter wire with attached microdendrites, at the tips of which extremely high field strengths occur in an electric field causing the ionization of analyte substances supplied to the tips of the dendrites. The ion currents obtainable by field-desorption ionization are very poor as compared to other ionization techniques, for instance by approximately a factor of 1000 smaller as for electron impact ionization.

Using the field-desorption ionization technique, analyte substances, which can't be vaporized without decomposition, are usually supplied to the dendrites of these electrodes by wetting the dendrites with a solution of the analyte substances outside of the mass spectrometer. Thereat solvents are used evaporating at ambient air due to the volatility of the solvents or in the vacuum of the mass spectrometer, into which the electrodes are introduced by means of a probe through a probe port. This way the analyte substances are adsorbed to the dentrites as mono-layers or thin layers, being almost free of solvent immediately ahead of and during recording of spectra. The transport of analyte molecules, adsorbed to the dendrites, towards the ionizing tips of the dendrites takes place by means of surface diffusion, which can be raised by raising the temperature for instance by heating of the wire of the electrodes.

Gases as well as liquid or solid substances respectively, which can be vaporized without decomposition, are directly introduced into the vacuum of the mass spectrometer as vapors by means of a sample feed pipe, which ends several millimeters to several centimeters away from the electrode, i.e. in a relatively large distance as compared to the diameter of the electrodes. Thus the introduced gaseous substances impinge the dendrites only to some extend, but miss the dendrites to a large extend due to the diffusion in the vacuum of the mass spectrometer, and are lost for the analysis.

Further electrodes are known for electro-spray ionization of liquid and/or dissolved substances consisting of a feed pipe not being equipped nor being in contact with micro-dendrites. The electro-spray ionization technique is usually performed at ambient pressure and needs several differential pumping stages in order to transfer produced ions into the vacuum of the mass spectrometer. The yield of ions detectable by mass spectrometry is extremely small being below 1:1000 relative to the bulk of consumed analyte substance.

DESCRIPTION OF THE INVENTION

It is an object of the present invention, to establish a method which results in a very effective ionization of analyte substances, the ion currents of which being more than two orders of magnitude higher than those of for instance the field-desorption ionization method, and to provide an apparatus for ionization of analyte substances effecting an efficient, time saving, and ion optically very advantageous sample supply to the dendrites and micro-tips, almost free from losses, thus making possible a high sample throughput per time unit at very soft ionization conditions.

The object is solved in that way that the method provides for temporary vacuum stable solvents designed for the supply of dissolved analyte substances, floating the molecules of the analyte substances towards the ionizing tips of the micro-dendrites, acting as a transport matrix with high surface mobility, this way delivering an intense supply of analyte molecules to the ionizing tips of the dendrites, and in that way that the apparatus provides for sample supply to the micro-dendrites in vacuo by means of a sample feed pipe, the orifice of which being equipped with micro-dendrites, which are either directly positioned at the feed pipe of at a substratum, e.g. a wire, such a way that the dendrites immerse into the orifice of the feed pipe or come this close to the orifice that the meniscus of an emerging droplet of the analyte solution touches the dendrites and is able to wet them.

The embodiment of the method of the invention, described in the claims, effects that the temporary vacuum stable solvent acts, for a time span sufficient for taking spectra, as a liquid matrix conveying the spectra, as a liquid matrix conveying the dissolved analyte substances to the ionizing tips of the microdendrites with a high surface diffusion rate thus resulting in a comparably strong ion current. The embodiment of the apparatus of the invention, described in the claims and shown in the figures, effects that the dissolved analyte substances, supplied to the ion source through the orifice of the feed pipe, impinge the dentrites directly and are concentrated at the dendrites and micro-tips due to partial evaporation of the solvent, without getting lost for analysis to a large extend by spraying.

In addition to the effective utilization of the analyte substances, a further advantage of the invention is the comparably high sample throughput resulting from the fact that several time consuming working cycles are skipped for subsequent analyses which are required for the field-desorption ionization method, e.g. removing the electrodes from vacuum in order to apply dissolved analyte substances and subsequent re-inserting into the vacuum of the mass spectrometer.

An additional advantage of the invention is, that the focusing parameters of the ion source continue to operate optimally after each supply of analyte substances to the dendrites in agreement with the invention, whereas they don't after each removing of the electrodes linked to sample application and subsequent reinserting, thus requesting for re-optimization of the ion optics for each mass spec analysis due to mechanical tolerances.

The separate supply of matrix and analyte substances through several, for example concentric feed pipes coordinated to one and the same arrangement of micro-dendrites is designed for the case that the mixture is advantageously performed immediately ahead or during the analysis for instance in order to avoid that the matrix influences a preceding chromatographical treatment of the analyte substances.

DESCRIPTION OF THE DRAWINGS

The invention is depicted in FIGS. 1 through 4.

Figure 1:
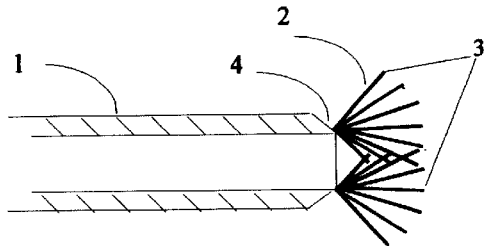
FIG. 1 shows the cross section of a sample feed pipe 1 equipped with dendrites 2 with micro-tips 3 at its orifice 4.
Figure 2:
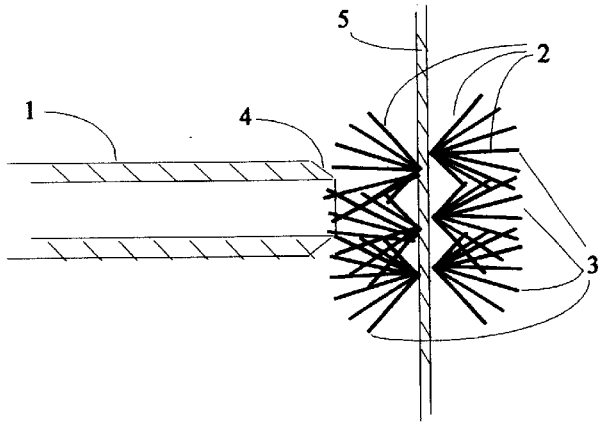
FIG. 2 represents dendrites 2 with micro-tips 3 attached to a substratum 5, e.g. a wire, and coordinated to the feed pipe 1 such a way that the dendrites 2 immerse into the orifice 4 of the feed pipe 1.
Figure 3:
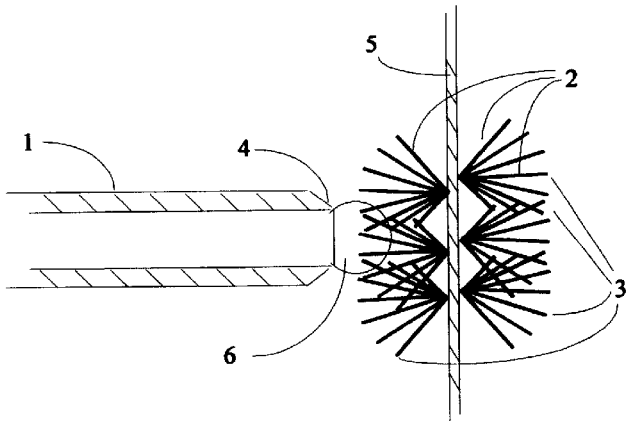
FIG. 3 depicts dendrites 2 with micro-tips 3 which are coordinated to the orifice 4 of the feed pipe 1 in a distance of several hundredth of a millimeter such a way, that a droplet 6 of the analyte solution emerging from the orifice 4 of the feed pipe 1 immerses into the arrangement of micro-dendrites 2 effecting a direct contact of the emerging analyte solution with the micro-dendrites 2.
Figure 4:
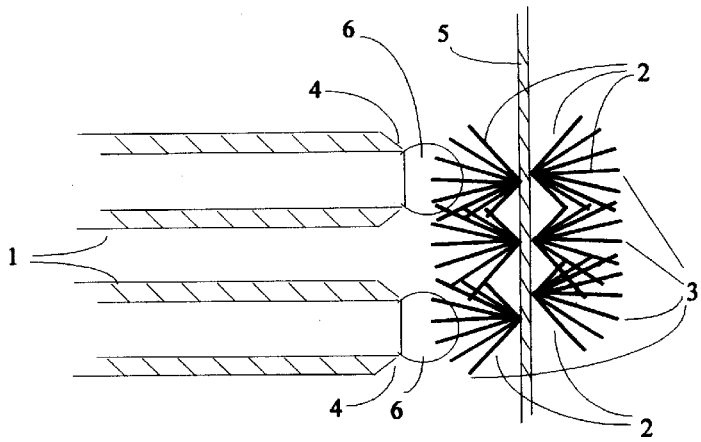
FIG. 4 shows several sample feed pipes 1 the orifices 4 of which being coordinated to an arrangement of micro-dendrites 2 with micro-tips 3 according to the invention.

In the claims:

1. Method of ionization of analyte substances at the tips of micro-dendrites under the influence of a high electric field, characterized in that the analyte substances are supplied to the ionizing micro-tips of the micro-dendrites as a component of a liquid matrix which has a high surface mobility and which is vacuum stable for a certain period of time.

2. Apparatus for ionization of analyte substances at the tips of microdendrites under the influence of a high electric field, characterized in that dendrites with micro-tips are positioned directly at or in a distance of two to nine parts of a millimeter from a sample feed pipe.

3. Apparatus according to claim 2 characterized in that micro-dendrites with micro-tips are directly positioned at the orifice of the sample feed pipe.

4. Apparatus according to claim 2 characterized in that micro-dendrites with micro-tips are positioned at a substratum in a distance of several micrometer from the orifice of the sample feed pipe enabling the micro-tips of the micro-dendrites to immerse into the orifice of the feed pipe.

5. Apparatus according to claim 2 characterized in that micro-dendrites with micro-tips are positioned at a substratum close to the orifice of the sample feed pipe in such a small distance that the micro-tips of the micro-dendrites immerse into a droplet of the liquid matrix emerging from the orifice of the pipe.

6. Apparatus according to claim 2 characterized in that micro-dendrites with micro-tips are positioned at the orifice or close to the orifice of individual feed pipes.

* * * * *